US005525243A

United States Patent [19]

Ross

[11] Patent Number: 5,525,243

[45] Date of Patent: Jun. 11, 1996

[54] HIGH COHESION FIBER FINISHES

[75] Inventor: Stanley E. Ross, Greer, S.C.

[73] Assignee: Henkel Corporation, Plymouth Meeting, Pa.

[21] Appl. No.: 298,637

[22] Filed: Aug. 31, 1994

[51] Int. Cl.[6] ..... D06M 13/00; D06M 13/10

[52] U.S. Cl. ..... 252/8.6; 252/8.7; 252/8.75; 252/8.8; 252/8.9; 8/115.6

[58] Field of Search ..... 252/8.6, 8.7, 8.75, 252/8.8, 8.9; 8/115.6; 427/389.9

[56] References Cited

U.S. PATENT DOCUMENTS

| | | | |
|---|---|---|---|
| 3,773,463 | 11/1973 | Cohen et al. | 8/495 |
| 3,914,496 | 10/1975 | Jorek et al. | 252/8.6 |
| 3,997,450 | 12/1976 | Steinmiller | 252/8.7 |
| 4,069,160 | 1/1978 | Hawkins | 252/8.8 |
| 4,072,617 | 2/1978 | Jahn | 252/8.9 |
| 4,098,703 | 6/1978 | Crossfield et al. | 252/8.6 |
| 4,115,621 | 9/1978 | Hawkins | 428/395 |
| 4,400,281 | 8/1983 | Dehm | 252/8.6 |
| 4,725,371 | 2/1988 | Lees et al. | 252/8.9 |
| 4,883,604 | 11/1989 | Vietenhansl et al. | 252/8.6 |
| 4,995,884 | 2/1991 | Ross et al. | 252/8.6 |
| 5,139,873 | 8/1992 | Rebouillat | 252/8.6 |

FOREIGN PATENT DOCUMENTS

| | | | |
|---|---|---|---|
| 280206 | 8/1988 | European Pat. Off. | 252/8.9 |
| 57-128267 | 8/1982 | Japan | 252/8.8 |

*Primary Examiner*—Anthony Green

*Attorney, Agent, or Firm*—Ernest G. Szoke; Wayne C. Jaeschke; Real J. Grandmaison

[57] ABSTRACT

A finish composition and process for enhancing the cohesion of fibers and textile materials wherein the composition contains from 7 to 20 weight percent of an antistatic agent, from 0 to 80 weight percent of an emulsifier, from 15 to 50 weight percent of a polyethylene glycol, and the balance, a lubricant.

38 Claims, No Drawings

HIGH COHESION FIBER FINISHES

BACKGROUND OF THE INVENTION

1. Field of the Invention

This invention relates to a composition and process for enhancing both bundle cohesion in synthetic continuous filament fibers and scroop in staple fibers. More particularly, it has been surprisingly found that a fiber finish composition containing a lubricant, anti-static agent and polyethylene glycol, increases the fiber-to-fiber friction coefficients in synthetic textile fibers.

2. Discussion of Related Art

Finishing compositions are generally applied to textile fibers to improve their subsequent handling and processing. Fiber finishes play an important role in assisting the fiber producer to manufacture the product, and enable the fiber producer's customers to carry out the required yarn and fabric manufacturing processes to obtain the finished textile product. The composition and amount of finish composition applied depend in large measure upon the nature, i.e., the chemical composition of the fiber, the particular stage in the processing of the fiber, and the end use under consideration.

For example, compositions referred to as "spin finishes" are usually applied to textile fibers after extrusion. These or other finishes which may be applied to yarn prior to knitting or winding, and to fiber tows prior to or at the time of crimping, drying, cutting, drawing, roving, and spinning, or to staple fibers prior to carding, i.e., web formation, and subsequent textile operations such as yarn manufacture or preparation of nonwoven webs are commonly called secondary or over-finishes. Such finishes provide lubrication, prevent static build-up, and afford a slight cohesion between adjacent fibers.

The application of such finishes is generally accomplished by contacting a fiber tow or yarn with a solution or an emulsion comprising at least one component having anti-static properties. In addition to a lubricant and anti-static agent, wetting agents, additives such as antioxidants, biocides, anti-corrosion agents, pH control agents, as well as emulsifiers are also commonly found in such finish mixtures. Finish compositions can also be applied to tow, yarn, or cut staple by spraying.

Acceptable finishes must fulfill a number of requirements in addition to providing desired lubricating and antistatic effects. For example, they should be easy to apply (and to remove if desired), they should have good thermal and chemical stability, they should not adversely affect the physical or chemical properties of the fibers to which they are applied and they should aid the subsequent processes to which the treated fibers are subjected, they should not leave residues on surfaces or cause toxic fumes or undesirable odors, they should provide for rapid wetting of fiber surfaces, they should be water-soluble or emulsifiable or solvent-soluble, they should have good storage stability, they should be compatible with sizes, nonwoven binders and other fiber treatments, they should not attract soil or cause color changes to the fibers, they should not interact with frictional elements used in texturizing and they should not be corrosive to machine parts.

Of the numerous compositions which have been proposed as fiber finishes, some of the more noteworthy may be found in the following prior art. For example, U.S. Pat. No. 4,072,617 discloses a finish for acrylic fiber consisting of an alkyl phenol ethoxylated with 40 to 200 moles of ethylene oxide, an amine salt of hydrogenated tallow alcohol phosphate, and a mixture of mineral oil, an ethoxylated aliphatic monohydric alcohol, and the amine-neutralized reaction product of an ethoxylated aliphatic monohydric alcohol phosphate. In addition, U.S. Pat. No. 3,997,450 relates to a finish composition for synthetic fibers such as polyamides and polyesters, consisting essentially of a lubricant selected from a mono- or diester of an aliphatic carboxylic acid with a monohydric aliphatic alcohol, or a refined mineral, animal or vegetable oil; an emulsifier containing up to 50 moles of alkylene oxide per mole of ester, alcohol, or amide wherein the reactive hydroxyl sites of the emulsifiers contain deactivating and cap groups; and an alkali salt of a dialkyl sulfosuccinic acid. Likewise, U.S. Pat. No. 4,725,371 is directed to a finish for the texturing of partially oriented polyester yarn wherein the composition has a pH of at least 10, and comprises an oil-in-water emulsion wherein the oil phase constitutes 2 to 25 weight percent of the emulsion. The oil phase comprises a lubricant selected from mineral oils, alkyl esters, glycerides, silicone oils, waxes, paraffins, naphthenic and polyolefinic lubricants, glycols, glycol esters, and alkoxylated glycol esters. The emulsifiers employed include soaps, glycerol fatty acid esters, sorbitan and polyoxyethylene sorbitan esters, polyglycerol esters, polyoxyethylene esters or ethers, polyoxyethylene polyol ether esters, polyoxyethylene amines and amides, partial polyol ester ethoxylates, sulfated vegetable oils, sulfonated hydrocarbons, and the like.

The purpose of a fiber finish is to provide fiber to metal lubrication and fiber to fiber cohesion, as well as eliminate static electricity. Although much of the basic work to elucidate the mechanisms of lubrication was done in the distant past, results of this work continue to be used to understand and apply results of frictional testing to current problems and the development of new finishes.

The contribution of frictional and antistatic properties can be observed throughout fiber manufacturing and processing. An example is the case of a low denier polypropylene staple fiber which is to be carded into a web and thermally bonded for some disposable nonwoven application. This requires a formulation which in conjunction with the fiber crimp, contributes a relatively high fiber to fiber friction which is important in insuring a carded web with good cohesion, uniformity, and integrity, and which compensates for the low stiffness of the fibers. Low fiber to metal friction is also a key factor in the processing of these staple fibers which have diameters on the order of only 15 to 20 micrometers.

Another example involves a slit film or ribbon type yarn intended for woven carpet backing for tufted carpets. During its manufacture, good wetting of the fiber surface by the finish and moderate frictional coefficients are required. For tufting, however, relatively low fiber to metal friction is a very important feature because of the action of tufting needles on the backing fabric.

Finally, low fiber to fiber friction is a highly desirable feature of continuous filament yarns used in cordage applications which involve twisting and plying to form compact structures which have a large amount of fiber to fiber contact. Low friction is desirable since it is generally associated with high flex resistance, high energy absorption and therefore, long life.

A different area of fiber-to-fiber friction is concerned with continuous filament yarns. This may be illustrated by some examples within the fiber manufacturing plant: package building in spinning and filament drawing or tow drawing are the major steps where the fiber-to-fiber friction is of critical importance. In yarn processing, yarn delivery in coning, stitch formation in knitting, filament damage in braiding, strength and elongation in cordage, slippage of weave in fabric, yarn-to-fabric friction in sewing, are some of the areas where yarn-to-yarn friction is important. Unfortunately, prior art finish compositions fail to provide adequate friction coefficients with respect to the bundle cohesion and scroop of synthetic fiber filaments. This lack of adequate bundle cohesion results in the following problems: migration of filaments from bundles in tri-color yarns resulting in color streaking; difficulty in handling yarns in a direct tuft carpet process in which yarns are not twisted prior to tufting resulting in stray filaments being snagged; the filament twisting process if hindered due to the filaments separating from the main body of the fiber bundle; during fiber manufacture multiple wraps of the multifilament bundles are taken on various rolls wherein the bundles have a tendency to wander resulting in individual filaments from one bundle becoming trapped in an adjacent bundle causing a breakdown in the process. Finally, there is also a need in the industry to improve the seam slippage in synthetic fabrics, and particularly those made of polypropylene fibers.

Accordingly, it is an object of this invention to overcome the aforementioned disadvantages of the prior art and provide the afore-noted desired advantages.

DESCRIPTION OF THE INVENTION

Other than in the operating examples, or where otherwise indicated, all numbers expressing quantities of ingredients or reaction conditions used herein are to be understood as modified in all instances by the term "about."

The foregoing and other related objects are achieved, and the disadvantages of the prior art are obviated, by the provision of a finish composition for fiber and textile applications wherein the composition comprises (1) from about 5 to about 25 weight percent of an antistatic agent, (2) from about 15 to about 50 weight percent of a polyethylene glycol having a molecular weight in the range of about 200 to about 1000, (3) from about 0 to about 80 weight percent of an emulsifier, and (4) the balance, a lubricant, all weights being based on the weight of the composition.

In those cases in which the lubricant is water soluble, it is not always necessary to use a traditional emulsifier since in polypropylene technology, for example, emulsifiers are frequently used as lubricants. However, in those cases in which the lubricant is insoluble or marginally soluble, an emuslifier may be required to emulsify or solubilize the lubricant. In general, from about 0 to about 80% of an emulsifier will be present in the composition of the invention, depending upon the solubility of the lubricant employed.

The composition is applied to textile fibers as an aqueous emulsion containing from 10 to 40 weight percent based on active ingredients.

The antistatic agent may comprise any suitable anionic, cationic, amphoteric or nonionic antistatic agent. Anionic antistatic agents are generally alkali sulfates or phosphates such as the phosphate esters of alcohols or ethoxylated alcohols. Cationic antistatic agents are typified by the quaternary ammonium salts and imidazolines which possess a positive charge. Examples of nonionics include the polyoxyalkylene derivatives. The anionic and cationic materials tend to be more effective antistats. Preferred anionic antistatic agents for use herein include an alkali neutralized phosphate ester such as commercially available from Henkel Corporation, Mauldin, S.C., under the tradenames Tryfac 5559 or Tryfac 5576. Preferred nonionic antistatic agents include ethoxylated fatty acids (Emerest 2650, an ethoxylated fatty acid), ethoxylated fatty alcohols (Trycol 5964, an ethoxylated lauryl alcohol), ethoxylated fatty amines (Trymeen 6606, an ethoxylated tallow amine), and alkanolamides (Emid 6545, an oleic diethanolamine). Such products are commercially available from Henkel Corporation, Mauldin, S.C.

The amount of antistatic agent present in the finish composition is generally from about 5 to about 30 weight percent when there is a possiblity that static electricity may be a problem. In some cases less might be required, for example, for continuous filament yarns which are interlaced or for a winding operation. In other cases such as for staple fiber processing, larger amounts of antistatic agent may be required. Thus, if a 20% emulsion is used at a wet pickup of 5%, 1% finish will be left on the fiber after the water has evaporated. Of this 1%, 0.1 to 0.25% will be the amount of antistatic agent on the fiber. It should be noted, however, that these weight percentages of antistatic agent on the fiber are premised on the assumption that there is 10% antistat (1%×10%=0.1%) or 25% antistat (1%×25%=0.25%).

The emulsifier may comprise any suitable emulsifying agent. Typical emulsifiers include an unethoxylated ester such as sorbitan monolaurate, ethoxylated ester such as ethoxylated sorbitan monooleate, ethoxylated fatty acid such as ethoxylated oleic acid, and ethoxylated alcohol such as ethoxylated $C_{11}$–$C_{15}$ alcohol or combination thereof. An alkali metal soap of a fatty acid such as potassium oleate may be included with an ethoxylate emulsifier, but it is not necessary. Preferred emulsifiers include an ethoxylated sorbitan monooleate (POE(5)) such as commercially available from Henkel Corporation, Mauldin, S.C., under the tradename Emsorb 6901; POE (9) oleic acid under the tradename Emery 2646; and a polyethylene glycol ether of secondary alcohol commercially available under the tradename Tergitol® 15-S-3 from Union Carbide Corporation, Danbury, Conn.

The lubricant component of the fiber finish is preferably selected from the group consisting of ethoxylated fatty acids such as the reaction product of ethylene oxide with pelargonic acid to form PEG 300 monopelargonate (Emerest 2634) and PEG 400 monopelargonate (Emerest 2654), the reaction product of ethylene oxide with coconut fatty acids to form PEG 400 monolaurate (cocoate) (Emerest 2650) and PEG 600 monolaurate (Emerest 2661), and the like. The lubricant component can also be selected from non-water soluble materials such as synthetic hydrocarbon oils, alkyl esters such as tridecyl stearate (Emerest 2308) which is the reaction product of tridecyl alcohol and stearic acid, and polyol esters such as trimethylol propane tripelargonate (Emery 6701) and pentaerythritol tetrapelargonate (Emery 2484).

The lubricant component of this invention is emulsifiable and capable of forming a stable emulsion with water. By the term "stable emulsion" it is meant that the emulsion is stable at the time of application of the emulsion finish to the yarn surface. This is meant to include oil-in-water finishes which may be mixed just prior to their application to the yarn surface and which may be stable only under conditions of mixing and application. Typically, however, the finish will be mixed well prior to yarn application and then applied via various applicators from a storage tank or the like and thus the emulsion must be stable for extended time periods.

The polyethylene glycol component has a molecular weight in the range of about 200 to 1000, and preferably about 400. The viscosity of the polyethylene glycol is preferably in the range of about 20 to 80 centistokes, and most preferably about 45 centistokes, at a temperature of 100° F. The oxyethylene content of the polyethylene glycol component is from about 4 to about 20 moles, and preferably about 4 to 17 moles. The polyethylene glycol is employed as a bundle cohesion additive and is preferably completely soluble in water at a temperature of 20° C.

The fiber and textile finish composition may be applied to virtually any fiber material including glass, cellulosics such as acetate, triacetate, rayon, non-cellulosics such as acrylics, modacrylic, nylon, aramid, olefins such as polyethylene and polypropylene, polybenzimidazole, polyesters such as polyethylene terephthalate and polybutylene terephthalate or copolyesters thereof, saran, spandex and vinyon.

The present invention will be better understood from the examples which follow, all of which are intended to be illustrative only and not meant to unduly limit the scope of the invention. Unless otherwise indicated, percentages are on a weight-by-weight basis.

EXAMPLE I

A finish composition for fiber and textile applications was prepared having the following formulation.

| Component | %/wt. |
|---|---|
| (a) Trylube 7640 | 75 |
| (b) PEG 400 | 25 |
| | 100.0 |

(a) Trylube 7640, an anionic fiber finish available from Henkel Corporation, Textiles Group, Mauldin, S.C., is a blend of the reaction product of ethylene oxide and pelargonic acid, and the amine neutralized phosphate ester and water (b) PEG 400, a polyethylene glycol having an average molecular weight of about 400, available from Union Carbide under the tradename Carbowax PEG 400.

The ingredients listed above and in the following examples, were mixed together at ambient temperature using agitation. In each case the resultant mixture was a clear liquid. Aqueous emulsions were prepared by adding the neat finish composition to water at ambient temperature while agitating the water. The resultant preparation in each case was a fluid, translucent emulsion.

EXAMPLE II

A finish composition for fiber and textile applications was prepared as in Example I having the following formulation:

| Component | %/wt. |
|---|---|
| (a) Trylube 7640 | 50 |
| (b) PEG 400 | 50 |
| | 100.0 |

EXAMPLE III

A finish composition for fiber and textile applications was prepared as in Example I having the following formulation:

| Component | %/wt. |
|---|---|
| (a) Dacospin 233 | 75 |
| (b) PEG 400 | 25 |
| | 100.0 |

(a) Dacospin 233, an anionic fiber finish available from Henkel Corporation, Textiles Group, Charlotte, N.C., is a blend of ethoxylated caprylic, capric and coconut fatty acids, and the neutralized reaction product of an aliphatic monohydric alcohol phosphate and water.

(b) PEG 400, a polyethylene glycol having an average molecular weight of about 400, available from Union Carbide under the tradename Carbowax PEG 400.

EXAMPLE IV

A finish composition for fiber and textile applications was prepared as in Example I having the following formulation:

| Component | %/wt. |
|---|---|
| (a) Emerest 2634 | 75 |
| (b) PEG 400 | 25 |
| | 100.0 |

(a) Emerest 2634, available from Henkel Corporation, Mauldin, S.C., is the reaction product of ethylene oxide and pelargonic acid and is identified as PEG 300 monopelargonate.

(b) PEG 400, a polyethylene glycol having an average molecular weight of about 400, available from Union Carbide under the tradename Carbowax PEG 400.

EXAMPLE V

A finish composition for fiber and textile applications was prepared as in Example I having the following formulation:

| Component | %/wt. |
|---|---|
| (a) Stantex 1621 | 85 |
| (b) PEG 400 | 15 |
| | 100.0 |

(a) Stantex 1621, a nonionic fiber finish available from Henkel Corporation, Textiles Group, Charlotte, N.C., is a blend of the reaction products of ethylene oxide and caprylic, capric and coconut fatty acids, an ethoxylated phenolic derivative as the nonionic antistatic agent and water.

(b) PEG 400, a polyethylene glycol having an average molecular weight of about 400, available from Union Carbide under the tradename Carbowax PEG 400.

EXAMPLE VI

A finish composition for fiber and textile applications can be prepared as in Example I having the following formulation:

| Component | %/wt. |
|---|---|
| (a) tridecyl stearate | 45 |

-continued

| Component | %/wt. |
|---|---|
| (b) PEG 400 | 20 |
| (c) K salt of aliphatic monohydric alcohol phosphate | 10 |
| (d) alcohol & acid ethoxylates and soap | 20 |
| (e) water | 5 |
| | 100.0 |

Table 1 summarizes the typical properties of the finish compositions shown in Examples I–V.

TABLE 1

| PROPERTIES | EX. I | EX. II | EX. III | EX. IV | EX. V | EX. VI |
|---|---|---|---|---|---|---|
| Activity, %/wt. | 91.5–92 | 94–95 | 92.5–95 | 99 | 87–89 | 95 |
| Appearance | Clear, colorless liquid | Clear, colorless liquid | Clear, liquid | Clear, colorless liquid | Clear, pale yellow liquid | Clear, pale yellow liquid |
| Ionic Character | anionic | anionic | anionic | nonionic | nonionic | nonionic |
| Moisture, % | 8.0–8.5 | 5–6 | 5–7.5 | 1 | 11–13 | 5 |
| Sp. Gr., 25° C. | 1.05 | 1.04 | 1.07 | 1.06 | 1.06 | 1.05 |
| Density, lb/gal., 25° C. | 8.7 | 8.6 | 8.9 | 8.8 | 8.8 | 8.7 |
| pH, 5% distilled water | 5.5–6.5 | 5.5–6.5 | 4.5–6.5 | 4.5–6.5 | 4–6 | 6–8 |
| Viscosity, 100° F., cs | 35–55 | 35.–55 | 45–55 | 40–50 | 45–55 | 35–55 |
| Thermal Properties: Flash Pt, °F., (C.O.C.) | >200 | >200 | >200 | >200 | >200 | >200 |

The finish compositions disclosed in the foregoing examples are eminently suitable for fiber and textile applications due to their overall properties. Thus, according to another aspect of the invention there is provided a process for enhancing the cohesion of multiple synthetic fibers comprising contacting the synthetic fibers with an effective amount of the above-described high cohesion fiber finish composition.

Polyamide fiber (filament) will typically require from about 0.75 to about 1.0% finish to be applied on the fiber from a 15% or 20% active solution or emulsion (5% wet pickup). Polyester fiber may require from 0.5 to 0.75% finish to be applied onto the fiber from a 15 or 20% active solution or emulsion. In general, however, the wet pickup is on the order of about 3% to about 8%, and preferably about 4 to 5%, while finish on fiber will be on the order of about 0.5% to about 1.0%.

The finish composition may be applied onto the filament according to a variety of known procedures. For example, in the melt spinning process used for polypropylene manufacture, the polymer is melted and extruded through spinnerette holes into filaments which are cooled and solidified in an air stream or water bath. Shortly after, they contact a finish composition applicator which can be in the form of a kiss roll rotating in a trough. The amount of finish composition applied to the filaments can be controlled by the concentration of finish composition in the solution or emulsion and the total wet pick-up. Alternatively, positive metering systems may be used which pump the finish composition to a ceramic slot which allows the finish composition to contact the moving filaments.

From this point, the yarn which now has a coating of finish composition moves forward into any of several processes. The amount of finish composition to be applied onto a synthetic filament is also dependent on the end product of the filament yarn. If staple fiber is the desired product, the filament bundles are combined into large tows, oriented by stretching, crimped, and cut into short lengths for processing on textile equipment to ultimately make yarn or nonwoven webs. In this instance, it is the "scroop" of the fibers which is intended to be enhanced. In order to do so, it is prefered the finish composition have a concentration in the range of from about 0.5 to about 1.0, based on percent actives. If continuous filament yarn is the desired product, the filaments are also oriented but as discrete bundles containing a specific number of filaments and are wound as long continuous lengths. In this case, the "bundle cohesion" of the filaments are enhanced by applying the finish composition of the present invention having a concentration in the range from about 0.75 to about 1.25, based on percent actives. There are several versions of this process.

In one version the unoriented or undrawn yarn is wound on a package, and drawn on a drawtwister. In another version called spin draw, the drawing operation is carried out in a continuous fashion on the same equipment without the step of winding the undrawn yarn.

Texturized yarns are also made as continuous filament yarns. Again, texturized yarns can be made by texturizing a fully oriented yarn or by simultaneously orienting and texturizing a partially oriented yarn.

In some of these processes the original spin finish composition application carries the fibers through the entire process. In others, supplementary or overfinishes are applied somewhere later in the process.

Finish Composition Evaluations

As earlier indicated herein, frictional, antistatic, thermal, and wetting properties of the finish composition are crucial with regard to fiber performance.

Frictional properties can be readily measured by applying known amounts of finish composition to yarns under controlled conditions in the laboratory. Recognizing that laboratory measurements at best only simulate actual use conditions, they have nevertheless been found to be a reasonably good predictor of behavior. One of the well-known instruments for performing frictional measurements is the Rothschild F Meter. In case of fiber to metal friction, the measurement is carried out by pulling a yarn around a circular metal pin under conditions of known pretension and angle of contact. The output tension is measured and the coefficient of friction determined from the capstan equation $$T_2/T_1=e^{\mu\varepsilon}$$

where $T_1$ and $T_2$ are the incoming and outgoing tensions respectively, e the angle of contact in radians, and $\mu$ the coefficient of friction. The Rothschild instrument calculates and plots the coefficient of friction automatically. Some prefer to use the value of $T_2-T_1$ as a measure of the frictional force since strictly speaking the capstan equation is not accurately obeyed by compressible materials such as fibers.

There are a number of variables, both mechanical and physical, in addition to the pretension and angle of contact, which can influence friction results. Some of these are speed, surface roughness, surface temperature, ambient temperature and humidity, finish composition viscosity, uniformity of finish composition application, finish composition concentration on the fiber, and fiber size and shape. Thus, when performing laboratory frictional experiments to determine the performance of a finish composition, one should select a condition related to that which the yarn will be exposed, such as for example, frictional measurements against a heated surface.

The fiber to fiber friction measurement is carried out in a similar way except that the yarn is twisted around itself and the force determined to pull the yarn in contact with itself. Again, with a knowledge of the incoming tension, the angle of wrap, and the outgoing tension, the frictional coefficient can be determined. In the case of fiber to fiber friction, it is customary to distinguish between static and dynamic frictional coefficients. Static friction is determined at a low speed (on the order of 1 cm/min), and dynamic friction at a higher speed. When measuring low speed friction, a stick-slip phenomenon is sometimes observed. It is this measurement which is most closely related to the "scroop" observed with staple fibers, or the cohesion of staple fiber web as it emerges from a card, or the performance of a finish composition in yielding a yarn package which is stable and does not slough. The stick-slip phenomenon indicates that the static friction is higher than the dynamic friction and can be affected by the behavior of boundary lubricants.

Antistats function by either reducing the charge generation or by increasing the rate of charge dissipation. Most antistats operate by increasing the rate of dissipation and rely on atmospheric moisture for their effectiveness. A hydrophobic fiber such as polypropylene depends on an antistat coating to impart high surface conductivity for charge dissipation. There are several ways to assess the antistatic activity of a finish composition. During the measurement of fiber to metal friction and the passage of yarn around the metal pin, static charges are generated. The Rothschild friction meter has an electrostatic voltmeter attachment which measures the charge generated by the moving yarn. At periodic intervals, the static is discharged and allowed to rebuild. Correlation of the charge developed in this measurement with actual performance observed under various manufacturing and use conditions is generally very good provided the relative humidity is reasonably close to the test condition.

Another method for assessing the antistatic activity of a finish composition is to measure the time for a charge to dissipate after the fiber has been charged. This is called the half-life measurement, but it is not conducted on a moving yarn. Still another technique is to measure the resistivity of a non-moving yarn using an ohm-meter capable of measuring high resistance. Theoretically, the higher the resistance, the lower the conductivity and the poorer the antistat.

The effect of aging on antistat performance can also be determined by any of these methods. Migration of the antistat from the fiber surface to the interior can occur under certain conditions with a subsequent loss of surface antistatic activity.

The effect of frictional and static properties is generally obvious throughout fiber manufacture and processing. Fiber to fiber friction is important to the fiber producer in controlling formation and stability of filament yarn packages since sloughing can occur if it is too low. Also, if fiber to fiber friction is too low, there could be problems of poor web cohesion in carding of staple fibers. On the other hand, low fiber to fiber friction is very desirable for continuous filament yarns which are used in applications such as cordage which involves twisting and plying. Low friction is desirable since it is associated with high flex resistance and high energy absorption and therefore, long life. Fiber to metal friction is also very important in many of the fiber processes. Lower fiber to metal friction is generally preferred since there is less opportunity for damage to the fibers either by abrasion or heat generation as the yarn contacts metal surfaces.

What is claimed is:

1. A finish composition for fiber and textile materials comprising from about 5 to about 30 weight percent of an antistatic agent, from about 0 to about 80 weight percent of an emulsifier, from about 15 to about 50 weight percent of polyethylene glycol having a molecular weight in the range of about 200 to 1000, and the balance, a lubricant, all weights being based on the weight of said composition.

2. A finish composition as in claim 1 wherein said antistatic agent is selected from the group consisting of an amine neutralized phosphate ester, quaternary ammonium salts, alkali neutralized phosphate ester, imidazolines, alkali sulfates, ethoxylated fatty acids, ethoxylated fatty amines, ethoxylated fatty alcohols and alkanolamides.

3. A finish composition as in claim 2 wherein said antistatic agent is an amine neutralized phosphate ester.

4. A finish composition as in claim 2 wherein said antistatic agent is a quaternary ammonium salt.

5. A finish composition as in claim 2 wherein said antistatic agent is an alkali neutralized phosphate ester.

6. A finish composition as in claim 2 wherein said antistatic agent is an imidazoline.

7. A finish composition as in claim 2 wherein said antistatic agent is an alkali sulfate.

8. A finish composition as in claim 2 wherein said antistatic agent is an ethoxylated fatty amine.

9. A finish composition as in claim 2 wherein said antistatic agent is an ethoxylated fatty alcohol.

10. A finish composition as in claim 2 wherein said antistatic agent is an alkanolamide.

11. A finish composition as in claim 1 wherein said emulsifier is selected from the group consisting of an sorbitan monolaurate, ethoxylated sorbitan monolaurate, and ethoxylated alcohol.

12. A finish composition as in claim 11 wherein said emulsifier is an unethoxylated ester.

13. A finish composition as in claim 11 wherein said emulsifier is an ethoxylated ester.

14. A finish composition as in claim 11 wherein said emulsifier an ethoxylated alcohol.

15. A finish composition as in claim 1 wherein said polyethylene glycol has a molecular weight of about 400.

16. A finish composition as in claim 1 wherein said lubricant is selected from the group consisting of tridecyl stearate, polyol esters and synthetic hydrocarbon oils.

17. A finish composition as in claim 16 wherein said lubricant is an ethoxylated fatty acid derived from the reaction of ethylene oxide and pelargonic, caprylic, capric or coconut fatty acids.

18. A finish composition as in claim 1 having a pH of between about 4 and about 8.

19. A finish composition as in claim 1 diluted with water to provide an aqueous emulsion containing from about 10 to about 40 weight percent of active ingredients.

20. A process for treating a fiber or textile material with a finish composition, comprising contacting said fiber or textile material with a finish composition comprising from about 7 to about 20 weight percent of an antistatic agent, from about 0 to about 80 weight percent of an emulsifier, from about 15 to about 50 weight percent of a polyethylene glycol having a molecular weight of from about 200 to about 600, and the balance, a lubricant, all weights being based on the weight of said composition.

21. The process of claim 20 wherein said antistatic agent is selected from the group consisting of an amine neutralized phosphate ester, quaternary ammonium salts, alkali neutralized phosphate ester, imidazolines, alkali sulfates, ethoxylated fatty acids, ethoxylated fatty amines, ethoxylated fatty alcohols and alkanolamides.

22. The process of claim 21 wherein said antistatic agent is an amine neutralized phosphate ester.

23. The process of claim 21 wherein said antistatic agent is a quaternary ammonium salt.

24. The process of claim 21 wherein said antistatic agent is an alkali neutralized phosphate ester.

25. The process of claim 21 wherein said antistatic agent is an imidazoline.

26. The process of claim 21 wherein said antistatic agent is an alkali sulfate.

27. The process of claim 21 wherein said antistatic agent is an ethoxylated fatty amine.

28. The process of claim 21 wherein said antistatic agent is an ethoxylated fatty alcohol.

29. The process of claim 21 wherein said antistatic agent is an alkanolamide.

30. The process of claim 20 wherein said emulsifier is selected from the group consisting of an sorbitan monolaurate, ethoxylated sorbitan monolaurate and ethoxylated alcohol.

31. The process of claim 30 wherein said emulsifier is an unethoxylated ester.

32. The process of claim 30 wherein said emulsifier is an ethoxylated ester.

33. The process of claim 30 wherein said emulsifier an ethoxylated alcohol.

34. The process of claim 20 wherein said polyethylene glycol has a molecular weight of about 400.

35. The process of claim 20 wherein said lubricant is selected from the group consisting of ethoxylated fatty acids with chain lengths ranging from about 9 to 18 carbon atoms, butyl stearate, tridecyl stearate, polyol esters and synthetic hydrocarbon oils.

36. The process of claim 35 wherein said lubricant is an ethoxylated fatty acid derived from the reaction of ethylene oxide and pelargonic, caprylic, capric or coconut fatty acids.

37. The process of claim 20 having a pH of between about 4 and about 8.

38. The process of claim 20 wherein said composition is diluted with water to provide an aqueous emulsion containing from about 10 to about 40 weight percent of active ingredients.

* * * * *

UNITED STATES PATENT AND TRADEMARK OFFICE

CERTIFICATE OF CORRECTION

PATENT NO. : 5,525,243

DATED : Jun. 11, 1996

INVENTOR(S) : Stanley E. Ross

It is certified that error appears in the above-indentified patent and that said Letters Patent is hereby corrected as shown below:

In col. 8, line 67, delete "$e^{\mu e}$" and insert --$e^{\mu \theta}$--.

In col. 9, line 2, after "respectively," delete "e" and insert --$\theta$--.

Signed and Sealed this

Seventeenth Day of September, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,525,243

DATED : Jun. 11, 1996

INVENTOR(S) : Stanley E. Ross

It is certified that error appears in the above-indentified patent and that said Letters Patent is hereby corrected as shown below:

In col. 3, line 14, delete [if] and insert --is--.

In col. 4, line 6, delete [oleic diethanolamine] and insert --oleic diethanolamide--.

Signed and Sealed this

Fifteenth Day of October, 1996

*Attest:*

BRUCE LEHMAN

*Attesting Officer*

*Commissioner of Patents and Trademarks*